US006668734B2

(12) United States Patent
Lucas et al.

(10) Patent No.: US 6,668,734 B2
(45) Date of Patent: Dec. 30, 2003

(54) DISPOSABLE/RECYCLABLE PALLET AND METHOD

(75) Inventors: Philip J. Lucas, Golden, CO (US); Leo W. Mayer, Lakewood, CO (US)

(73) Assignee: Coors Brewing Company, Golden, CO (US)

( * ) Notice: Subject to any disclaimer, the term of this patent is extended or adjusted under 35 U.S.C. 154(b) by 9 days.

(21) Appl. No.: 10/102,193

(22) Filed: Mar. 20, 2002

(65) Prior Publication Data

US 2002/0129749 A1 Sep. 19, 2002

Related U.S. Application Data

(63) Continuation-in-part of application No. 09/809,678, filed on Mar. 14, 2001.

(51) Int. Cl.[7] ..... B65D 19/00

(52) U.S. Cl. ..... 108/51.11; 108/57.75; 108/51.3

(58) Field of Search ..... 108/57.25, 51.11, 108/51.3, 55.1, 56.1, 57.22, 57.31; 206/442, 497, 597, 590, 600, 526, 386

(56) References Cited

U.S. PATENT DOCUMENTS 2,614,688 A * 10/1952 Hammer ..... 108/56.3
2,614,689 A * 10/1952 Miller ..... 108/56.3
2,930,481 A * 3/1960 Beble ..... 108/56.3
3,236,197 A * 2/1966 Rossner ..... 108/56.3
3,788,462 A * 1/1974 Meincer ..... 206/597
3,880,286 A * 4/1975 Wegener ..... 108/56.3
4,802,421 A * 2/1989 Atterby et al. ..... 108/51.3
5,285,731 A * 2/1994 McIntyre ..... 108/51.3
6,012,399 A * 1/2000 Carter ..... 108/51.3

FOREIGN PATENT DOCUMENTS

FR 7323166 * 4/1979

* cited by examiner

*Primary Examiner*—Jose V. Chen
(74) *Attorney, Agent, or Firm*—Klaas, Law, O'Meara & Malkin, P.C.; William P. O'Meara; Nellie C. Kaufman

(57) ABSTRACT

A pallet for supporting a load of packages is disclosed. The pallet includes a support structure comprising flexible film wrapped around at least one of the layers of the load. The flexible film is wrapped around two axes which are generally perpendicular to one another and preferably located within the same plane such that the flexible film covers at least a majority of the layer(s). The pallet also includes a base positioned adjacent to the support structure which is adapted to receive forks of a forklift. The base may have an elongate tubular configuration and be constructed from a disposable/recyclable material.

24 Claims, 11 Drawing Sheets

DISPOSABLE/RECYCLABLE PALLET AND METHOD

CROSS-REFERENCE TO RELATED APPLICATION

The present application is a continuation-in-part of co-pending U.S. patent application Ser. No. 09/809,678 filed Mar. 14, 2001 for DISPOSABLE/RECYCLABLE PALLET AND METHOD of Philip J. Lucas et al., which is hereby specifically incorporated by reference for all that is disclosed therein.

FIELD OF THE INVENTION

The present invention relates generally to pallets used to support and transport a load of packages, and, in particular, to disposable and/or recyclable pallets and methods for producing the same.

BACKGROUND OF THE INVENTION

Pallets are typically used to support a load of packages, allowing the load to be lifted and transported by a lift truck such as a forklift. Several layers of packages may be loaded onto a pallet, and the load may then be secured around its circumference using, for example, flexible wrap or shrink-wrap in order to stabilize the load on the pallet.

Some pallets have a platform upon which the packages are loaded and a base having channels adapted to receive the "forks" of a forklift. These pallets, hereinafter referred to as "platform-type pallets", are typically constructed from wood or plastic, and may be re-used multiple times. Disadvantages to using platform-type pallets involve the cost of producing the pallet, space required for and cost of storing the pallets, cost of shipping the pallet and its load to their destination, and cost and inconvenience of shipping the pallet back from its destination so it may be reused. The shipping costs are even more significant for relatively heavier pallets (e.g., wood pallets). Due to weight restrictions, the amount of product that can be shipped with the relatively heavier pallets is reduced. Furthermore, while these pallets are generally reusable, they are subject to breakage (especially wood pallets).

A relatively thin and lightweight alternative to a platform-type pallet is known as a "slip sheet" or "slip pallet". Referring to FIG. 1, a conventional slip pallet 10 may be, for example, a thin sheet of lightweight material such as plastic having one or more extending edges 12. The slip pallet 10 is loaded with packages 20 and the packages are usually wrapped around the circumference of the load (i.e., around a vertical axis) in order to stabilize the load 22. A specially adapted lift truck 24 grasps an edge, e.g. 12, of the slip pallet 10, pulls the slip pallet 10 onto a platform 26, and then lifts and transports the load 22 as desired. As the load 22 is lifted and transferred onto the platform 26, the weight of the load 22 shifts from the leading end 14 to the opposite (trailing) end 16 (as indicated by "L1" and "L2"), possibly damaging packages (e.g., 20*a*, 20*b*) located on the lowermost layers 18 on these ends 14, 16. The greater the lift angle "A", the greater the weight "L2" exerted on the packages (e.g., 20*b*) located on the trailing end 16, especially those on the lowermost layers 18.

Using either a platform-type pallet or a slip pallet, additional damage may occur to the lowermost layers of packages during shipping due to vibration and jostling of the load.

In view of the above, it is an object of the present invention to provide a pallet that essentially functions as a disposable/recyclable platform-type pallet. It is also an object of the present invention to provide a pallet that provides a shock-absorbing effect during transport of the load. It is a further object of the present invention to provide a method for producing such a pallet.

SUMMARY OF THE INVENTION

A pallet for supporting a load of packages is disclosed. The pallet includes a support structure which may comprise flexible film wrapped around at least one of the layers of the load (e.g., the lowermost layer). The flexible film is wrapped around two axes which are generally perpendicular to one another and preferably located within the same plane such that the flexible film covers at least a majority of the layer(s). The pallet also includes a base which may comprise at least one elongate tubular member having an upper, outer surface positioned adjacent to the bottom surface of the support structure. The elongate tubular member may further comprise at least one opening therethrough which is adapted to receive forks of a forklift.

A method for producing the pallet of the present invention is also disclosed. The method includes the initial steps of wrapping at least one of the layers of the load with a flexible film around a first axis, and then wrapping the same layer(s) with a flexible film around a second axis which is generally perpendicular to the first axis and preferably located on the same plane, thereby producing a support structure. The base described above may be assembled by removably attaching a first portion to a second portion, thereby producing a first elongate tubular member having a first opening therethrough, and then removably attaching a third portion to a fourth portion, thereby producing a second elongate tubular member having a second opening therethrough. The support structure may then be placed on the assembled base.

BRIEF DESCRIPTION OF THE DRAWINGS

Illustrative and presently preferred embodiments of the invention are illustrated in the drawings in which.

DESCRIPTION OF THE PREFERRED EMBODIMENTS

Figure 1:
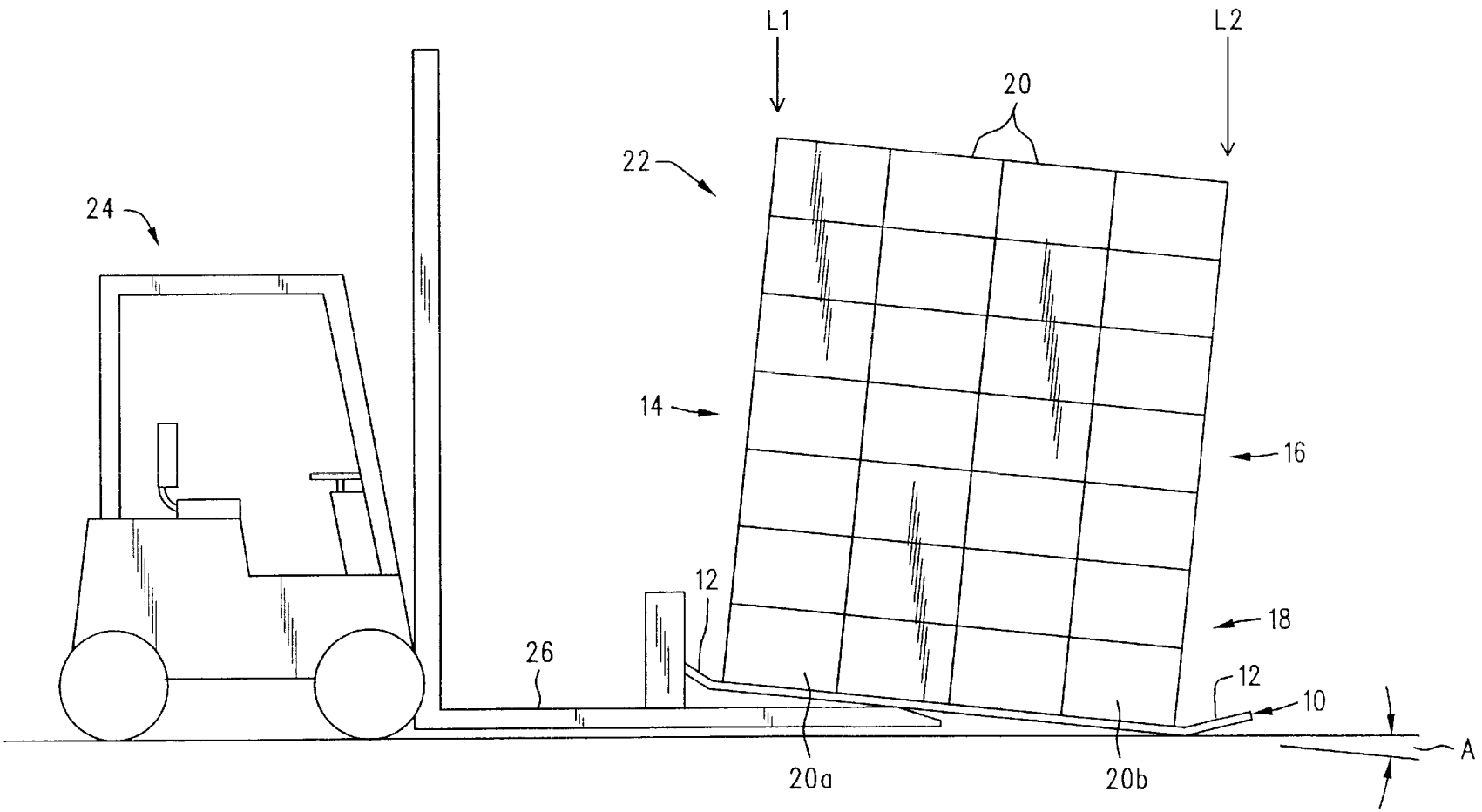
FIG. 1 (PRIOR ART)
FIG. 1 is a side elevation view of a lift truck manipulating a load on a conventional slip pallet.
Figure 2:
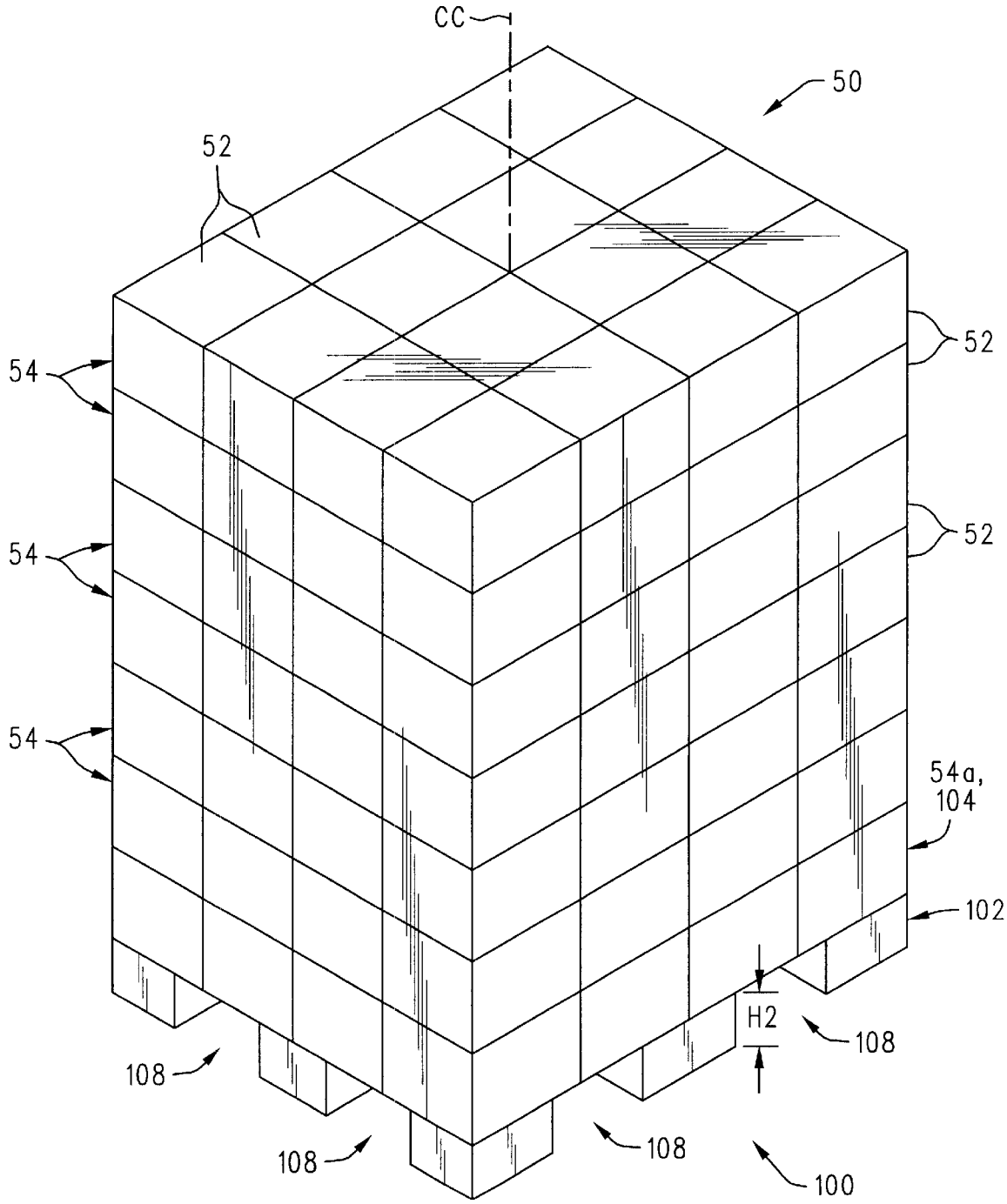
FIG. 2 is an isometric view of a load on the pallet of the present invention.

As shown in FIG. 2, the pallet 100 of the present invention is adapted to support a load 50 of packages 52, allowing the load to be lifted and transported by a conventional lift truck such as a forklift. A typical load 50 is comprised of several layers 54, including a lowermost layer 54*a*. The packages 52 may be, for example, rectangular-shaped cartons as shown in the drawings. However, these packages 52 are merely exemplary, and it is to be understood that the pallet 100 of the present invention may be adapted to support other types of packages. Furthermore, the size of the load 50 shown is also merely exemplary, and the pallet 100 of the present invention may be adapted to support other load configurations. For example, several loads 50 and pallets 100 may be stacked on top of one another, and the lowermost pallet 100 may be adapted to support all of the other loads 50 and pallets 100 thereon.

Figure 3:
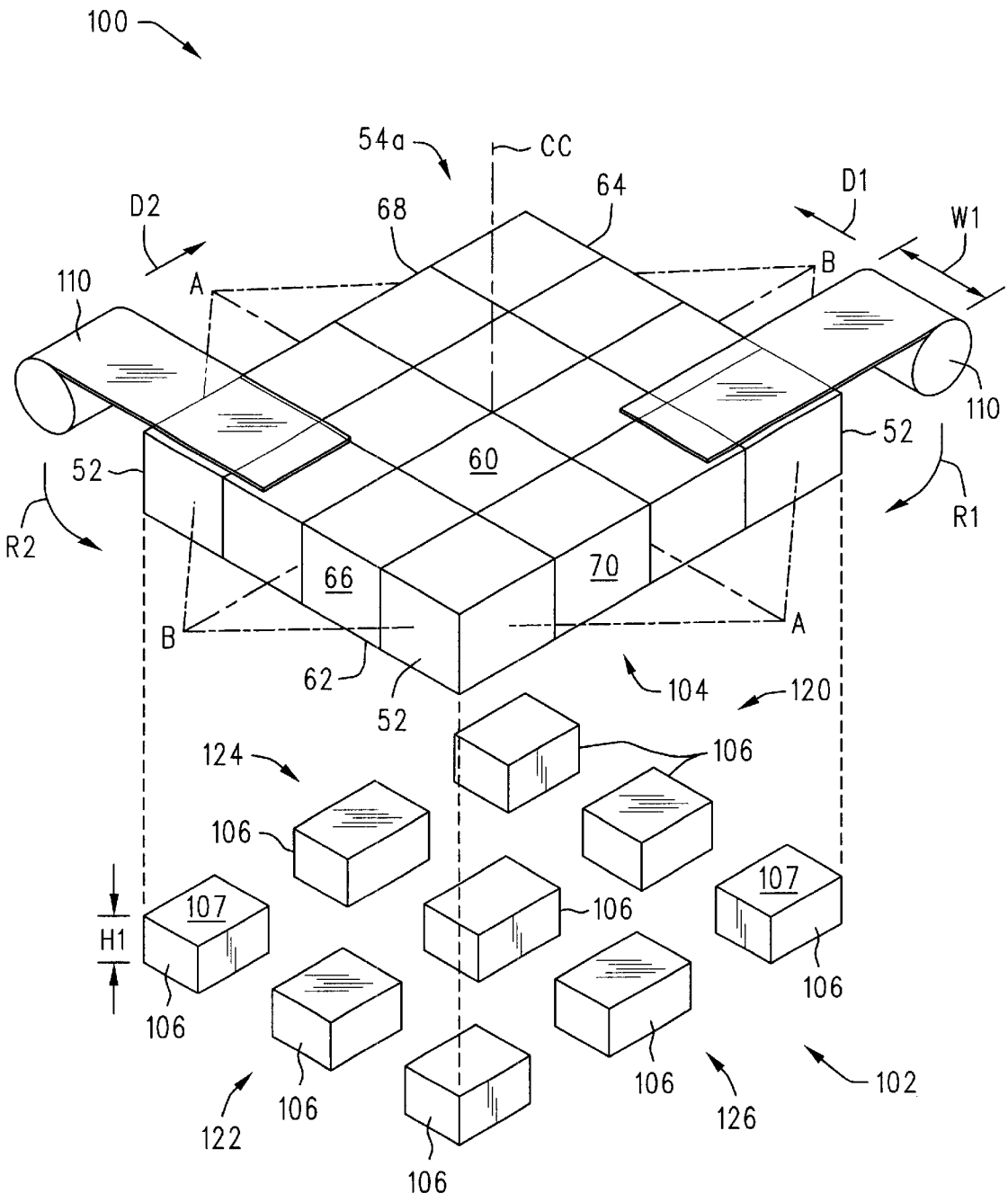
FIG. 3 is an isometric, exploded view of the pallet of FIG. 2 with the load removed.

As shown in FIGS. 2–3, the pallet 100 may comprise a base 102 and a support structure 104. The support structure 104 utilizes at least one of the lowermost layers (e.g., 54*a*) of the load 50 as a "platform" to support the remaining layers 54. While the lowermost layer 54*a* will be described relative to the support structure 104, it is to be understood that two or more layers 54 may be utilized to produce the support structure 104.

With reference to FIG. 3, a layer 54*a* of packages 52 is arranged adjacent to one another in a desired configuration, such as, for example, a square or rectangular configuration (commonly referred to as "palletization", or arranging packages into a pallet-sized layer). The layer 54*a* of packages 52 may comprise a top surface 60, a bottom surface 62, a first side surface 64, a second side surface 66, a third side surface 68, and a fourth side surface 70. The layer 54*a* of packages 52 is then wrapped in a flexible film 110 in the manner discussed below such that all of the surfaces 60, 62, 64, 66, 68, 70 (or at least a majority thereof) are covered in flexible film 110, allowing the wrapped layer 54*a* to function as a "support structure" to support the remaining layers 54 (FIG. 2), similarly to the platform of a platform-type pallet. Then, the base 102, which may be comprised of multiple pieces 106 of lightweight material, is adhered to the flexible film 110 on the bottom surface 62 of the layer 54*a*. After loading the remaining layers 54 of packages 52 onto the pallet 100, the entire load 50 (FIG. 2), may be secured around its circumference (i.e., around side surfaces 64, 66, 68, 70 of layer 54*a* and the corresponding side surfaces of the remaining layers 54) using, for example, flexible wrap or shrink wrap in order to stabilize the load on the pallet as is well-known in the art. By utilizing one or more layers 54 of the load 50 for the support structure 104, the entire pallet 100 may be dismantled upon arrival to its destination, and the entire pallet 100 and load 50 may be re-utilized, recycled, and/or disposed of. Specifically, the layer(s) 54 of packages 52 used for the support structure 104 will, of course, be utilized by the end-user along with the rest of the load 50. The flexible film 110 covering the layer(s) 54 as well as the base 102 may be constructed from disposable/recyclable materials. Thus, upon dismantling the pallet 100, the flexible film 110 and the base 102 may be disposed of and/or recycled. The term "disposable/recyclable" as used throughout this application is intended to encompass the conventional definitions of both the terms "disposable" and "recyclable", since an end-user of a disposable/recyclable product usually has the option of whether to dispose of or recycle the product.

The flexible film 110 may be, for example, a plastic stretch wrap material manufactured by ADU Stretch Films of Tulsa, Okla. The flexible film 110 may be wrapped around the packages 52 using conventional stretch wrap equipment such as that sold by Mima of Tamarac, Fla. (see "www.itwmima.com"). As shown in FIG. 3, the layer 54*a* of packages is preferably wrapped with flexible film 110 around two axes AA, BB. Specifically, the flexible film 110 may be applied to the top surface 60, first side surface 64, bottom surface 62, and second side surface 66 in a first direction, e.g., R1 (this direction may be either clockwise or counterclockwise), around axis AA. The film 110 is shifted along the load in direction D1, preferably overlapping the previous wrap somewhat, until all of the surfaces 60, 62, 64, 66 (or at least a majority thereof) are covered with flexible film 110. It may be desirable to cover the surfaces 60, 62, 64, 66 with more than one layer of flexible film 110, as described in further detail below. The flexible film 110 may then be applied to the top surface 60, third side surface 68, bottom surface 62, and fourth side surface 70 in a second direction, e.g., R2 (again, this direction may be either clockwise or counterclockwise), around axis BB. The film is shifted along the load in direction D2, preferably overlapping the previous wrap somewhat, until all of the surfaces 60, 62, 68, 70 (or at least a majority thereof) are covered with flexible film 110. Again, it may be desirable to cover the surfaces 60, 62, 68, 70 with more than one layer of flexible film 110, as described in further detail below. It may also be desirable to leave one or more openings (see FIG. 7) within the flexible film 110 on one or more of the surfaces (in particular, on the bottom surface 62 and one or more of the side surfaces 65, 66, 68, 70) to allow for drainage of a leaking package 52. The axes AA, BB are most preferably located on the same plane (e.g., horizontal plane ABAB), and these axes M, BB may be generally perpendicular to one another as shown in FIG. 3, so that the top surface 60 and bottom surface 62 are covered with twice as much flexible film 110 as the sides 64, 66, 68, 70.

As noted above, the base 102 is adhered to the flexible film 110 on the bottom surface 62 of the layer 54*a*. The base 102 must therefore be strong enough to support the entire load 50 (as well as other loads and disposable/recyclable pallets which may be stacked on top of this load as noted above), and is preferably constructed of a lightweight, recyclable/disposable material such as the plastic foam known as "Styrofoam". By utilizing a resilient material such as plastic foam, the base 102 provides a shock-absorbing effect and is a damper to harmonic oscillations which minimizes damage to the packages 52 due to vibration and jostling of the load 50 during transportation thereof. However, the base 102 may be constructed from other materials such as rubber, plastic, or wood, including materials which have previously been recycled such as prefabricated wood.

The base 102 may be adhered to the flexible film 110 on the bottom surface 62 using any conventional adhesive such as two-sided tape. However, by using an injection-molded material such as plastic foam (a.k.a. Styrofoam), the need to use a separate adhesive may be avoided. Specifically, when plastic foam is removed from a mold, it remains tacky for a certain period of time. In a first method, a base 102 constructed from plastic foam may be pressed onto the flexible film 110 on the bottom surface 62 of the packages 52 while the base 102 is still tacky and then allowed to fully cure, thereby securing the base 102 to the flexible film 110. In another method, a base 102 constructed from plastic foam which has already cured may be utilized. At least one surface on the base 102 (e.g., surface 107 on each of the pieces 106, FIG. 3) may be heated until that surface 107 is tacky or partially melted. Then, the tacky surface 107 may be pressed to the flexible film 110 on the bottom surface 62 of the packages 52. When the base 102 cools down, it will be adhered to the flexible film 110.

Figure 4:
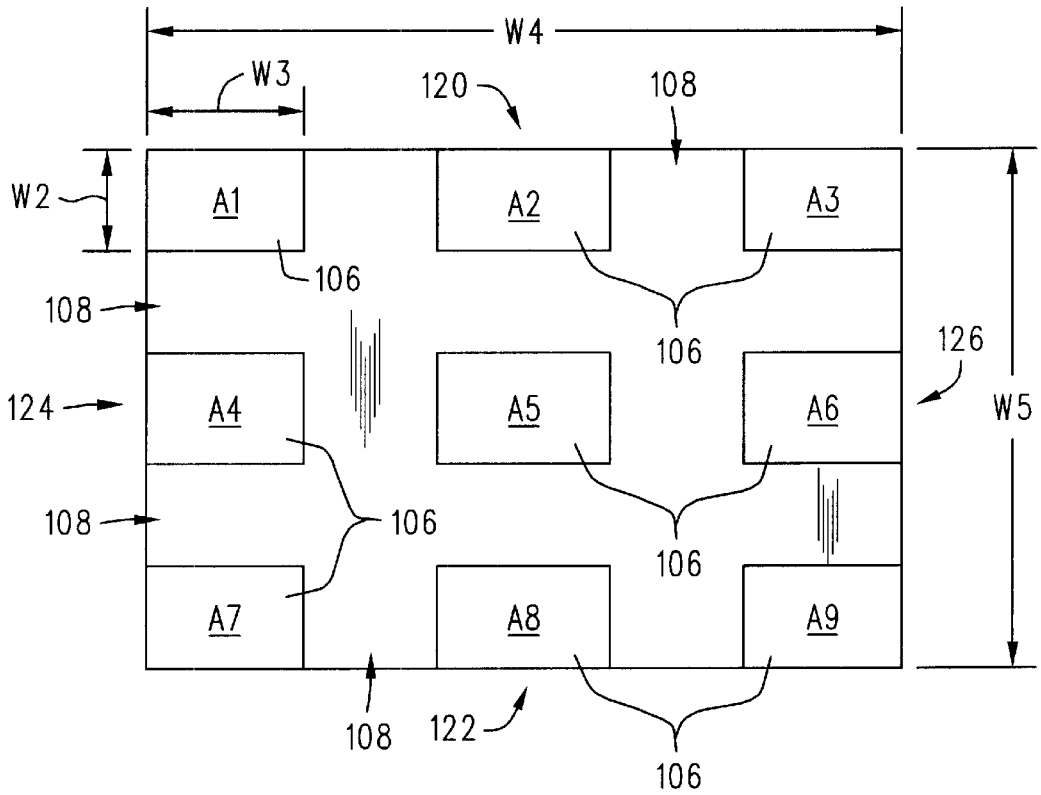
FIG. 4 is a bottom plan view of the pallet of FIG. 2.
Figure 5:
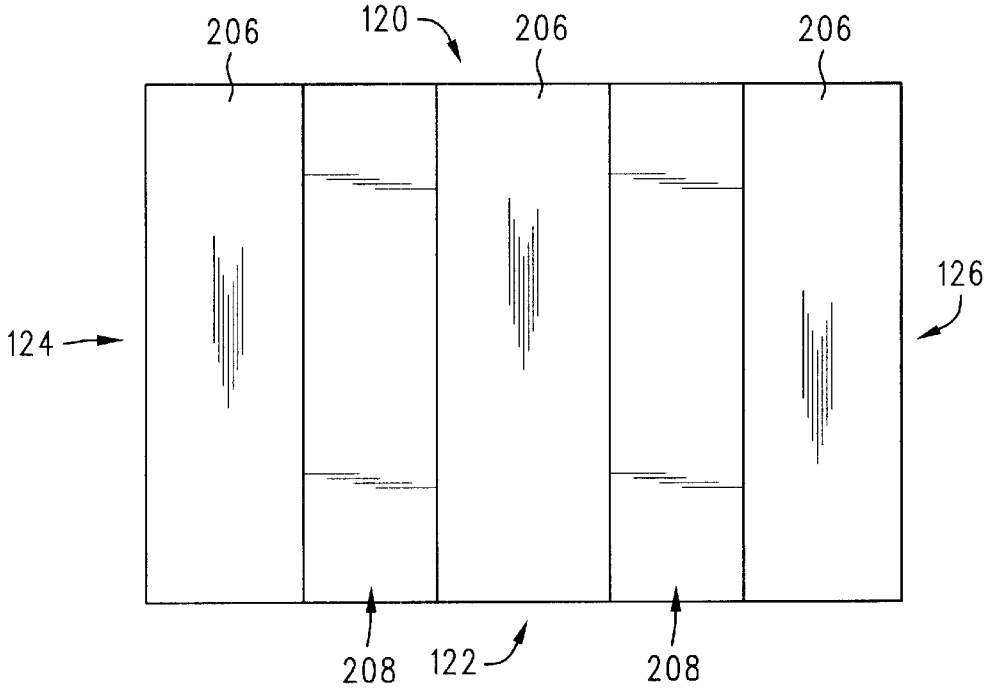
FIG. 5 is a bottom plan view of another embodiment of the pallet of FIG. 2.

As shown in FIGS. 2 and 4, the base 102 preferably includes channels 108 for receiving the forks (e.g., 56, FIG. 6) of a forklift. The base 102 may be adapted to receive the forks of a forklift from any side 120, 122, 124, 126 thereof as shown, or it may be adapted to receive a forklift from only two of those sides, e.g., 120, 122, as shown in FIG. 5. To create the channels 108 shown in FIGS. 2 and 4, an exemplary base 102 may be comprised of multiple pieces 106 as noted above. To create the channels 208 shown in FIG. 5, elongate pieces 206 may be provided which, other than their elongated shape, may be identical to the pieces 106 described herein. Alternatively (not shown), the base 102 may be comprised of a single piece of material as long as channels 108, 208 are provided for use by a forklift. For example, the pieces 106, 206 shown may be connected by thinner pieces of material within the channels 108, 208.

The pieces 106 should have a relatively uniform height "H1" (FIG. 3) which leaves enough clearance "H2" (FIG. 2) under the load 50 to allow the forks (e.g., 56, FIG. 6) of a forklift to be easily inserted into the channels 108. For example, the height of the pieces "H1" may be between approximately 3 and 4 inches. The clearance "H2" would be equal to the height of the pieces "H1" less any settling of the pieces 106 due to the weight of the load 50, the amount of settling depending partly on the material used for the base 102.

Referring now to FIG. 4, the pieces 106 may have any desired surface dimension, e.g., "W2" by "W3". While rectangular-shaped pieces 106 are shown in the drawings, it is to be understood that the pieces 106 may have any cross-sectional shape such as, for example, square, circular, or polygonal. Furthermore, the surface dimension of each pieces 106 need not be equal to the surface dimension of any other piece 106, except as necessary to create adequate channels 108. The "footprint" of the base is equal to the total surface area, for example "A1"+"A2"+"A3"+"A4"+"A5"+"A6"+"A7"+"A8"+"A9" of the pieces 106, where the surface area of each piece, e.g., "A1", is equal to the surface dimensions of each piece multiplied together, e.g., "W2"×"W3". The desired footprint as compared to the total surface area "W4"×"W5" of the bottom surface 62 depends on the weight of the load 50 as well as the material used for the base 102, as shown in the example below.

The particular characteristics of the flexible film 110 and the wrapping thereof, as well as the base 102, may vary according to particular characteristics of the load 50. As an example, a load 50 of packages 52 (which may contain, for example, filled beverage cans) may weigh approximately 2,200 lbs. To provide a sufficiently strong yet cost-efficient pallet 100 in accordance with the present invention, a flexible film 110 such as a plastic stretch wrap having a film gauge of between approximately 0.0075 and 0.0095 inches, and most preferably approximately 0.008 inches, may be utilized. This film 110 may have a pre-stretch of between approximately 100 and 200%, but most preferably closer to 200%. The stretch force setting on the stretch wrap equipment may be between approximately 20 and 50 lbs, and most preferably approximately 25 lbs. It should be noted that the film gauge and the stretch force setting should be carefully chosen with regard to the strength the packages and package contents. Specifically, a higher gauge film requires a higher stretch force setting, and a stretch force setting that is too high may cause damage to the packages 52 (especially cardboard packages).

In this example, the overlap noted above may be between approximately 25% and 40%, and most preferably approximately 30%, of the width "W1" (FIG. 3) of the flexible film 110. It was found that damage known as "corner crush" was minimized with a relatively low overlap (e.g., approximately 25% of "W1" in this example). However, lateral movement of the packages 52 was minimized with a relatively high overlap (e.g., approximately 50% of "W1"). Thus, the overlap may be adjusted to minimize the undesired effects. The total number of complete wraps around each axis AA, BB may be between three and five, i.e., the total number of layers of flexible film 110 in this example may be between six and ten. Should a stronger pallet be desired, and/or a heavier load applied, the total number of layers of flexible film may easily be increased, especially since the cost of the flexible film itself is typically relatively low.

To complete the pallet 100 described above, an exemplary base 102 constructed from 40-lb. to 60-lb. grade Styrofoam pieces 106 having a height "H2" of approximately 3 inches may be utilized. A base 102 having these characteristics may withstand a maximum load of approximately 40 lbs/in$^2$. The exemplary load of 2,200 lbs. would preferably utilize a base with a footprint (as defined above) of between about 25% to 40%, and most preferably approximately 30%, of the total surface area "W4"×"W5" of the bottom surface 62 of the layer 54*a*. While a base having a larger footprint may be used, the larger the footprint, the more difficult it may be to insert the forks (e.g., 56, FIG. 6) of a forklift into the channels 108. It is clear that the base 102 of the present invention uses much less material than conventional pallets. Additionally, it will be appreciated that plastic foam/Styrofoam is a relatively inexpensive material as compared to the materials from which conventional pallets are constructed, e.g., plastic or wood.

Referring to FIGS. 2 and 3, after the pallet 100 is created by wrapping one or more layers (e.g., 54*a*) in flexible film 110 and adhering a base 102 thereto, the remaining layers 54 may be loaded onto the pallet 100. Then, the entire load 50 may be wrapped around its circumference, i.e., around axis CC (a vertical axis which is generally perpendicular to axes AA and BB, and plane ABAB), with flexible film such as stretch wrap, shrink wrap, or the like in a manner well known in the art in order to laterally secure the load 50.

Figure 6:
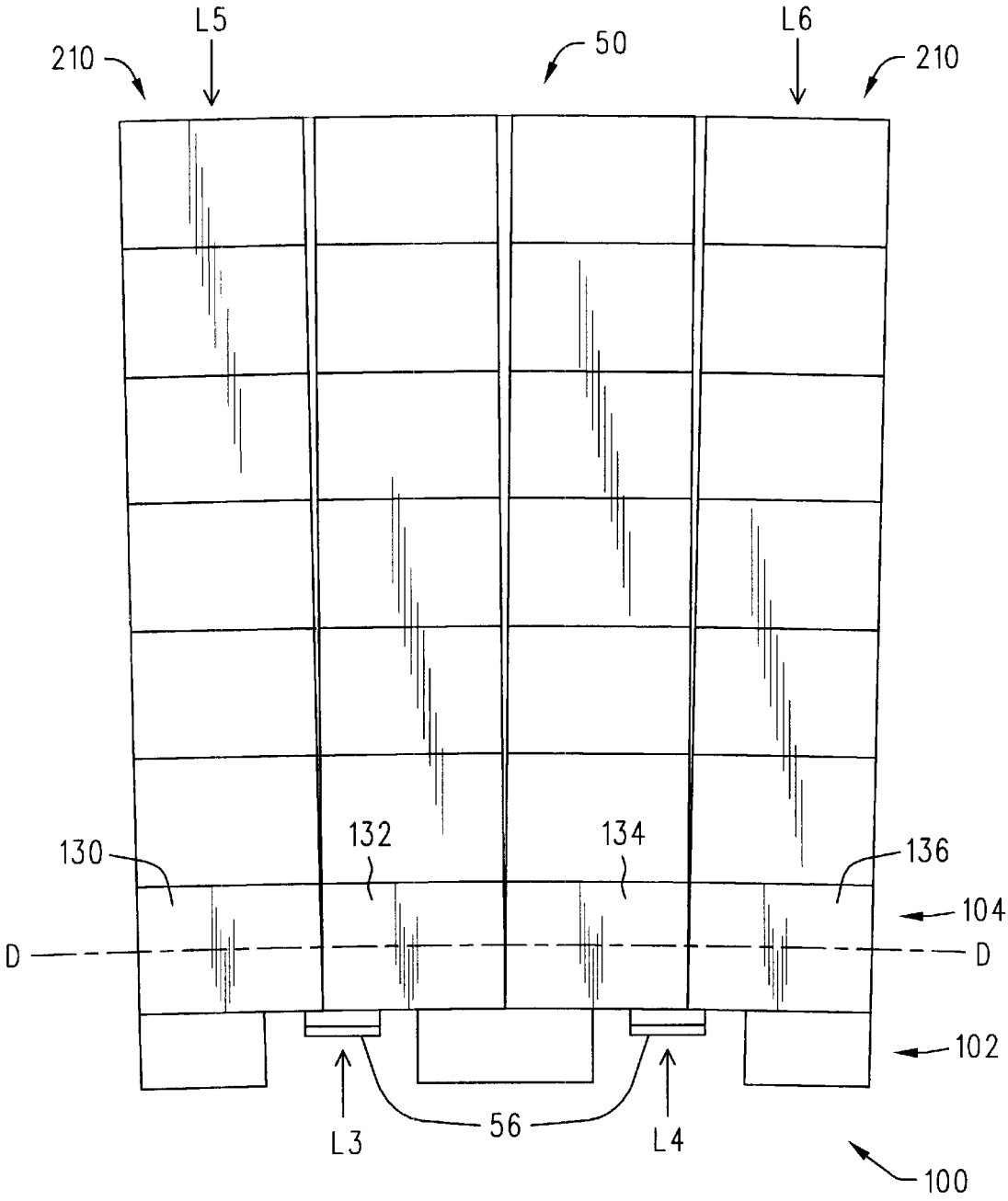
FIG. 6 is a front elevation view of a load on the pallet of FIG. 2 being lifted by the forks of a forklift.

FIG. 6 shows an exemplary load 50 on the pallet 100 of the present invention being lifted by the forks 56 of a forklift (not shown). When the wrapped load 50 is lifted, the lifting force "L3", "L4" of the forks 56 on the load 50 in combination with the weight "L5", "L6" of the outer periphery 210 of the load (e.g., the outer row(s) of packages) may cause the load to arch somewhat (as indicated by "DD"). However, since the support structure 104 of the pallet 100 is securely wrapped in two directions (e.g., around axes AA and BB, FIG. 3), and due to the friction between the individual packages (e.g., between packages 130 and 132, 132 and 134, 134 and 136) within the wrapped support structure 104, the support structure 104 does not allow this arching effect to threaten the stability of the load 50.

With reference to FIGS. 1–6, a method for producing the pallet 100 described above is also disclosed. The method may comprise the first step of wrapping at least one of the multiple layers (e.g., the lowermost layer 54*a*) of the load 50 with a flexible film 110 around a first axis AA or BB. The next step involves wrapping the same layer(s) 54*a* with a flexible film 110 around a second axis BB or AA which is generally perpendicular to the first axis and preferably located on the same plane ABAB. Then, a base 102 is adhered to the flexible film 110. If a plastic foam such as Styrofoam is utilized for the base 102, the step of adhering the base 102 to the flexible film 110 may comprise providing plastic foam pieces which are not fully cured, pressing the plastic foam pieces onto the flexible film, and then allowing the plastic foam pieces to fully cure, thereby causing the pieces to adhere to the flexible film 110. Alternatively, as noted above, a base 102 constructed from plastic foam which has already cured may be utilized. At least one surface on the base 102 (e.g., surface 107 on each of the pieces 106, FIG. 3) may be heated until that surface 107 is tacky or partially melted. Then, the tacky surface 107 may be pressed to the flexible film 110 on the bottom surface 62 of the packages 52. When the base 102 cools down, it will be adhered to the flexible film 110.

Figure 7:
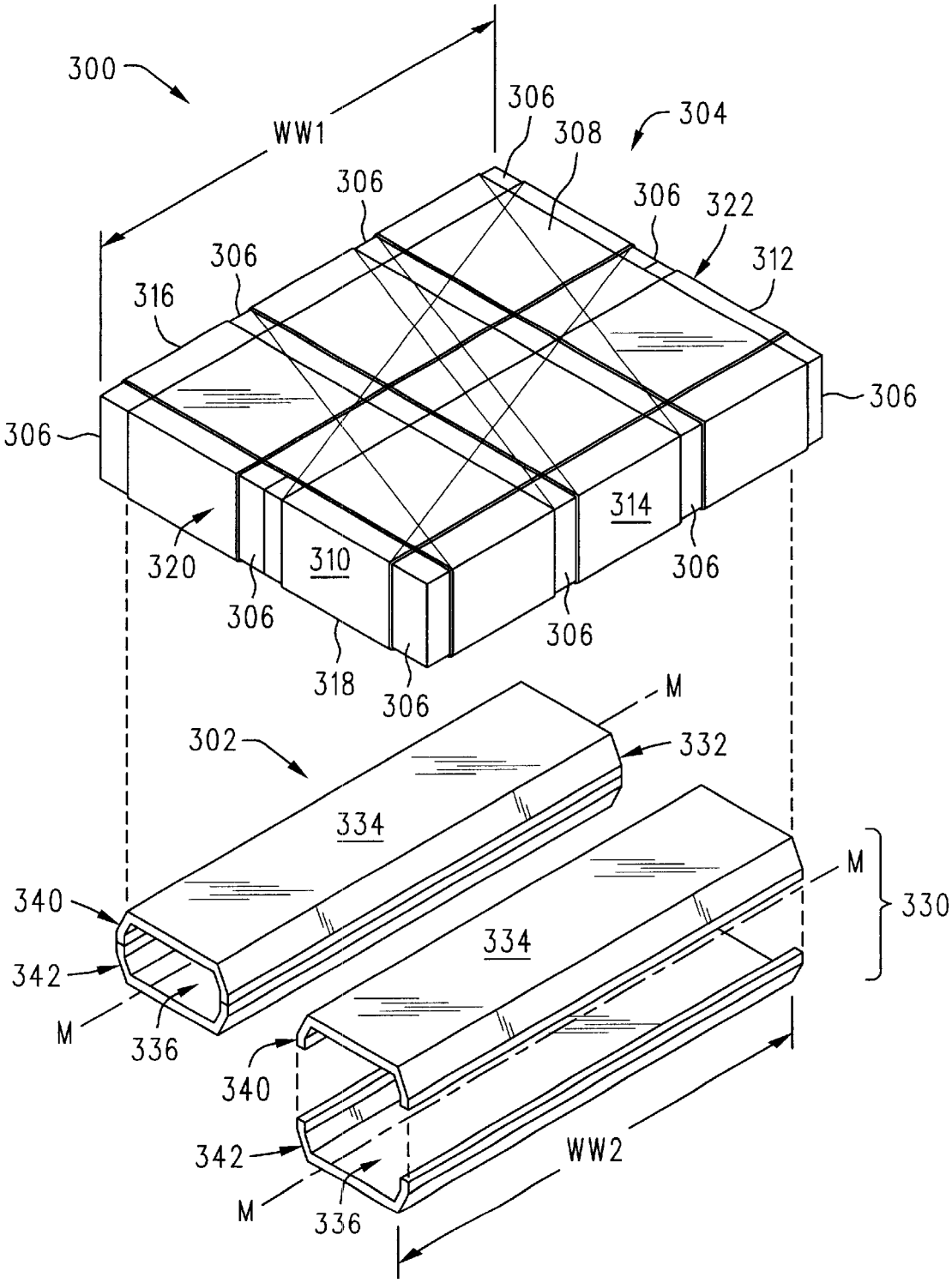
FIG. 7 is an isometric, exploded view of the pallet of the present invention with another embodiment of the base.

FIG. 7 illustrates a disposable/recyclable pallet 300 with another embodiment of the base 302. A support structure 304 is illustrated which may be assembled as described above relative to support structure 104, FIGS. 2 and 3. As noted above, it may be desirable to leave one or more openings 306 within the flexible film 308 on the support structure 304 (in particular, on the side surfaces 310, 312, 314, 316 and the bottom surface 318 of the support structure 304) to allow for drainage of a leaking package or the like.

Figure 8:
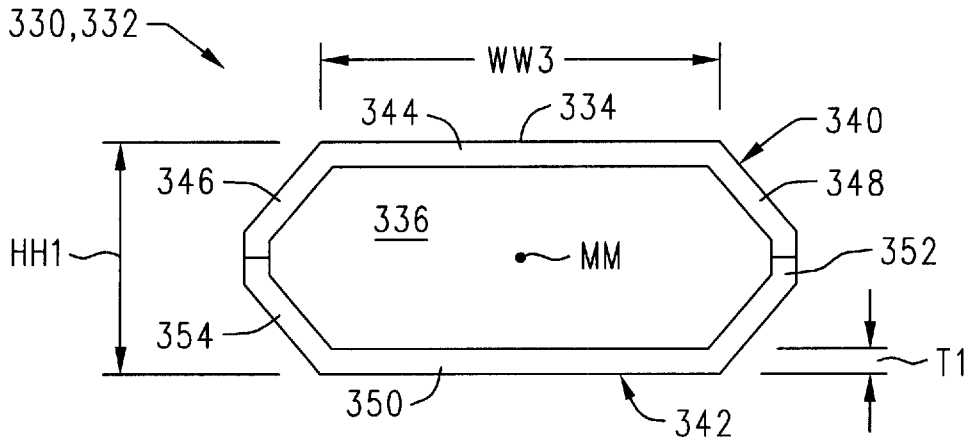
FIG. 8 is a front elevation view of an elongate tubular member of the base of FIG. 7.

The base 302 may comprise at least one, and most preferably two, elongate tubular member(s) 330, 332. FIG. 7 shows a first elongate tubular member 330 in a disassembled, exploded state and a second elongate tubular member 332 in an assembled state. Each of the elongate tubular members 330, 332 may be identical to one another and may comprise an upper, outer surface 334 having a width "WW3" (FIG. 8) which is adapted to be positioned adjacent to the bottom surface 318 of the support structure 304. As shown in FIGS. 7 and 8, each elongate tubular member 330, 332 may further comprise at least one opening 336 therethrough extending along a central longitudinal axis "MM". As described in further detail below, the openings 336 are adapted to receive the forks (e.g., 56, FIG. 10) of a forklift. In a preferred embodiment, each of the elongate tubular members 330, 332 is adapted to receive one fork (e.g., 56, FIG. 10) of a forklift.

As shown in FIG. 7, the support structure 304 may comprise a first end 320 which may correspond to a first side surface 310 and a second end 322 which may correspond to a second side surface 312. The distance between the first end 320 and the second end 322 is designated in FIG. 7 as "WW1". This distance corresponds to a surface dimension (e.g., length or width) of the support structure 304, which may vary depending on the surface dimensions of the load (e.g., 356, FIG. 10) to be supported. The length "WW2" of each elongate tubular member 330, 332 may be identical to or somewhat less than the distance "WW1" such that each elongate tubular member 330, 332 extends substantially from the first end 320 to the second end 322 of the support structure 304 (as it is used herein, "substantially" should be interpreted as being within approximately zero to 4 inches from each end 320, 322).

As shown in FIGS. 7 and 8, each elongate tubular member 330, 332 may comprise a first portion 340 removably attached to a second portion 342. For ease of manufacturing, the first and second portions 340, 342 may be substantially identical to one another. As shown in FIG. 8, the first portion 340 may comprise a first elongate, substantially planar panel 344 (which may include the upper, outer surface 334 described above) and a first pair of elongate side panels 346, 348 extending therefrom substantially parallel to the central longitudinal axis "MM". The second portion 342 may comprise a second elongate, substantially planar panel 350 and a second pair of elongate side panels 352, 354 extending therefrom substantially parallel to the central longitudinal axis "MM". To assemble the first and second portions 340, 342 into an elongate tubular member 330, 332 as shown in FIG. 7, one of the portions 340 or 342 may be inverted and aligned with another portion 342 or 340, respectively, and then the portions 340, 342 may be removably attached to one another as discussed in further detail below.

When assembled, the first and second portions 340, 342 may form a tubular structure having an eight-sided cross-sectional shape as shown in FIG. 8 having an opening 336 therethrough and a height "HH1" which may be equal to "H1" described above (the height of the base 102), or, alternatively, any height which accommodates a fork (56, FIG. 10) of a conventional forklift. The first and second portions 340, 342 of each of the elongate tubular members 330, 332 may be constructed from a disposable/recyclable (or reusable) material such as, for example, polystyrene, structural foam, expanded polystyrene, polypropylene, or polyethylene. The first and second portions 340, 342 may have a thickness "T1", the value of which may depend on the type of disposable/recyclable material used for the base 302 as well as the weight of the load 356 (FIG. 10) to be supported on the base 302. For example, to support a given load 356, a base 302 constructed from polystyrene ("Styrofoam") may require a greater thickness "T1" (at least at certain portions of the base; see description of FIG. 15 below) than a base 302 constructed from a relatively denser material such as, for example, polypropylene or polyethylene.

Figure 9:
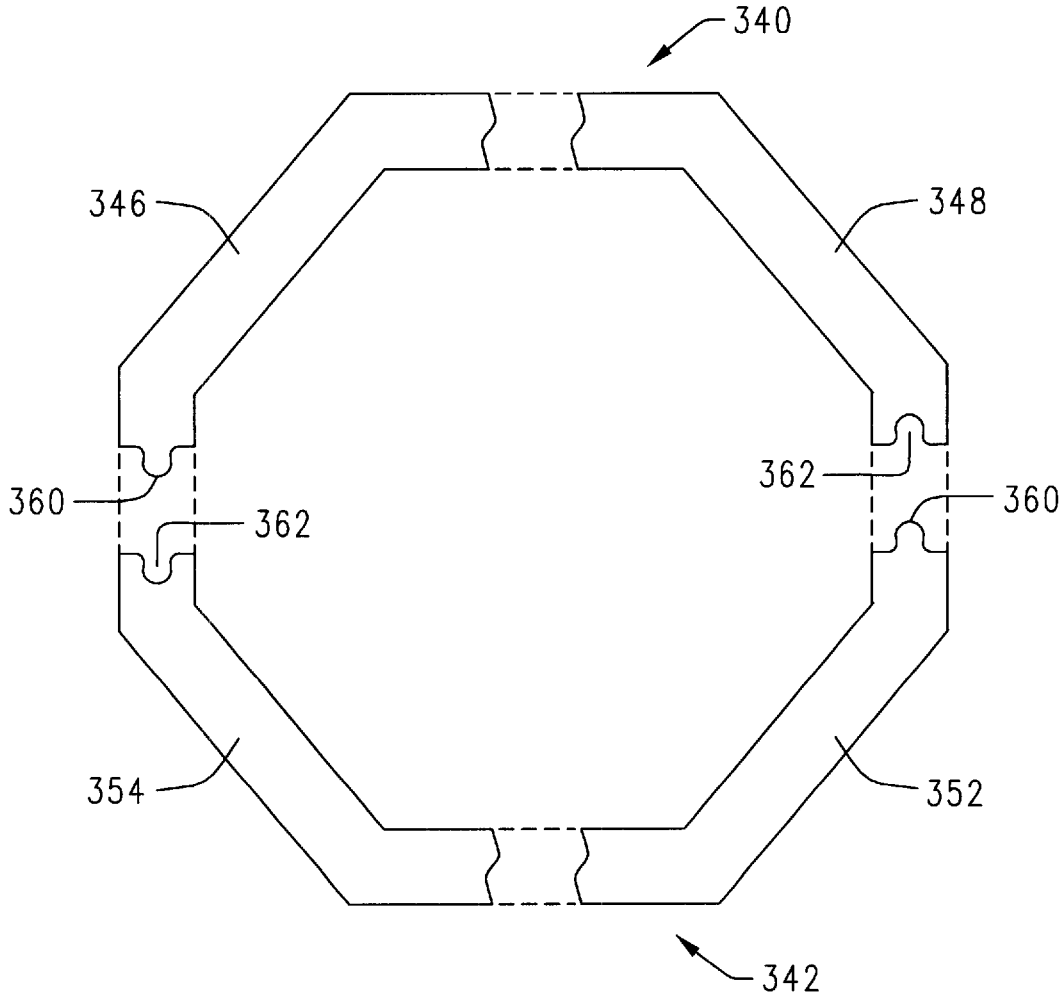
FIG. 9 is a detailed, partially exploded, front elevation view of the elongate tubular member of FIG. 8.

As shown in FIGS. 8 and 9, the first pair of elongate side panels 346, 348 in the first portion 340 may be removably attached to the second pair of elongate side panels 352, 354 in the second portion 342. The removable attachment of the first portion 340 to the second portion 342 may be accomplished in any conventional manner such as, for example, utilizing a tongue-and-groove configuration as shown in FIG. 9. For example, one of the elongate side panels (e.g., 346 or 352) in each of the first and second portions 340, 342, respectively, may have an extending member or "tongue" 360 that is adapted to be received within a channel or "groove" 362 in the opposite elongate side panel (e.g., 354 or 348, respectively). The portions 340, 342 may be "snapped" together (i.e., press or interference fit) by aligning the tongues 360 and their respective grooves 362 and pressing the portions 340, 342 together. It should be noted that, by utilizing both a tongue 360 and a groove 362 in each of the portions 340, 342, each of the portions 340, 342 may be identical to one another (simplifying manufacturing thereof) while also being removably attachable to one another simply by inverting one of the portions 340, 342 as described above. While a tongue-and-groove configuration is shown in FIG. 9, it is to be understood that the present invention is not limited to such a configuration, and any means, conventional or otherwise, for removably attaching the first and second portions 340, 342 may be utilized in the present invention.

Figure 10:
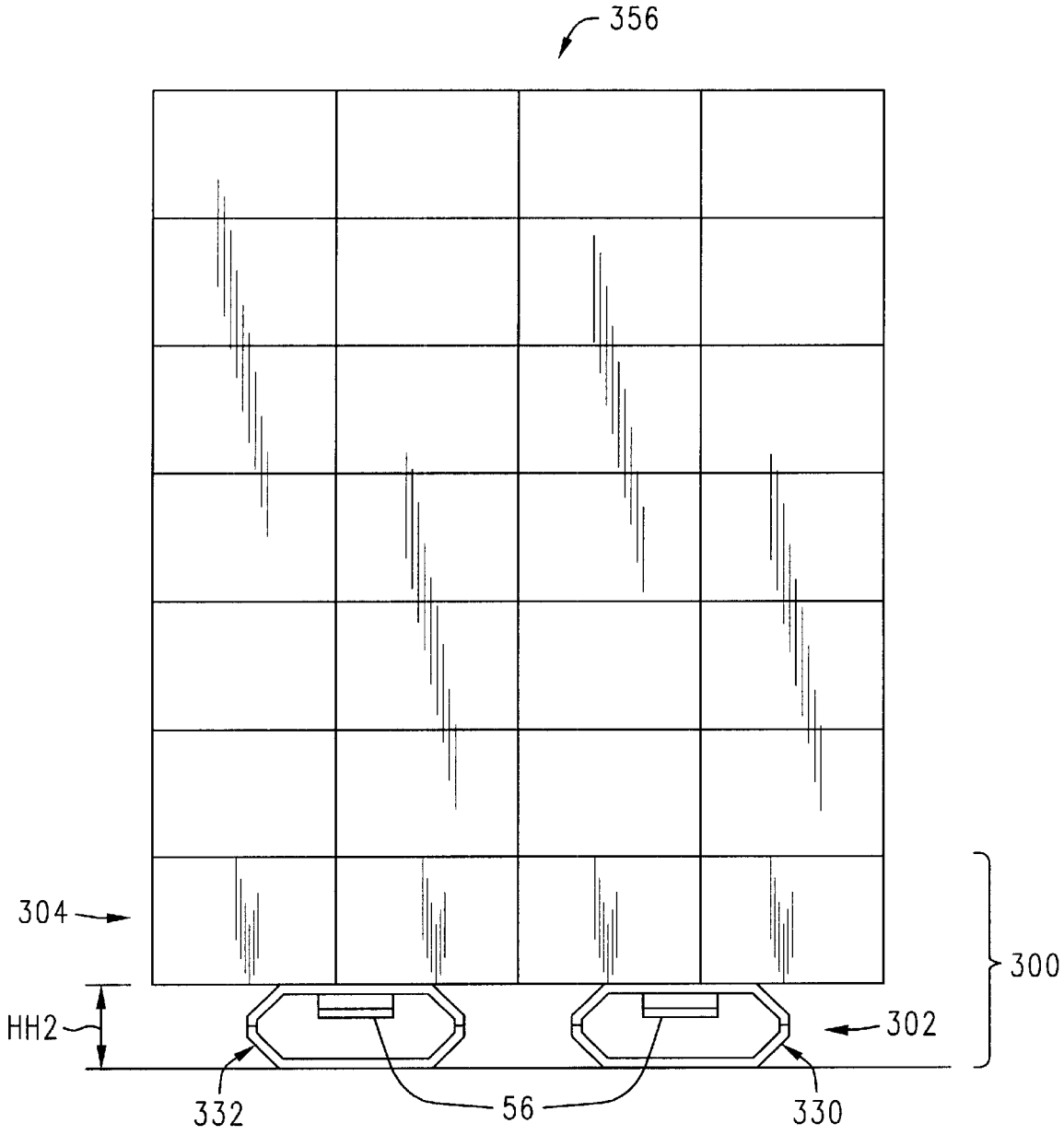
FIG. 10 is a front elevation view of a load on the pallet of FIG. 7 with forks of a forklift extending through the base thereof.

FIG. 10 illustrates an exemplary load 356 on a pallet 300 of the present invention. The pallet 300 includes a support structure 304 (which is part of the load 356 as described above relative to support structure 104, FIGS. 2–3) and a base 302 which is comprised of a pair of elongate tubular members 330, 332 in order to accommodate the forks 56 of a conventional forklift (not shown). The tubular configuration of the elongate tubular members 330, 332, as well as the disposable/recyclable material utilized for their construction (e.g., polystyrene, polypropylene, polyethylene, etc.), allows the elongate tubular members 330, 332, to deform slightly under a load 356. Thus, the height "HH2" of the base 302 under a load 356 will typically be somewhat less than the height "HH1" of an undeformed, unloaded base 302 (FIG. 8). As additional forces are applied to the load 356 (due to, for example, jostling of the load during assembly or transportation thereof), the base 302 is able to deform under such forces to provide a shock-absorbing effect which will minimize damage to the load 356.

As an example (with reference to FIGS. 7–10), in order to support a load 356 of approximately 2,200 lbs. (as well as up to two loads of the same size stacked thereon, for a total of 6,600 lbs.), a base 302 may be comprised of a pair of elongate tubular members 330, 332. Utilizing a support structure 304 having a distance "WW1" (FIG. 7) between a first end 320 and a second end 322 of approximately 39 inches, the length "WW2" of each elongate tubular member 330, 332 may be approximately 35 to 39 inches, and most preferably about 36 inches, such that each member 330, 332 extends substantially from the first end 320 to the second end 322 of the support structure 304. Such members 330, 332 that are constructed from, for example, structural foam, expanded polystyrene, polypropylene or polyethylene may have a thickness "T1" (FIG. 8) of between about ⅛ to ¼ inch, and most preferably about ¼ inch. Such members 330, 332 that are constructed from a relatively lower density material such as conventional polystyrene may require a greater thickness "T1" and/or relatively thicker portions such as, for example, portions 374 (FIG. 15) which may have a thickness "T2" of approximately 2 inches. In order to provide adequate support to the load 356 as well as to easily accommodate the forks 56 (FIG. 10) of a forklift, the width "WW3" (FIG. 8) of the upper, outer surface 334 of each of the members 330, 332, may be between about 5 to 12 inches, and most preferably about 8 inches. Each of the members 330, 332 may have an undeformed height "HH1" of between about 2 to 4 inches, and most preferably about 3 inches (again to easily accommodate the forks 56 of a forklift). Such a base 302 having the above characteristics is designed to withstand a load of approximately 40 lbs/in$^2$, or a total of approximately 6,600 lbs.

With reference to FIGS. 7–10, a method for producing the pallet 300 described above is also disclosed. The method may comprise the initial steps of wrapping at least one of the multiple layers of the load 356 with a flexible film 308 around a first axis, and then wrapping the same layer(s) with a flexible film 308 around a second axis (as described above relative to the support structure 104 shown in FIGS. 2–3), thereby producing a support structure 304. Then, the support structure 304 may be placed on a base 302 which may be assembled by removably attaching a first elongate tubular member 330 to a second elongate tubular member 332. As noted above, each of the elongate tubular members 330, 332 may have an opening 336 therethrough extending along a central longitudinal axis "MM" which is adapted to receive a fork 56 of a forklift. While an adhesive may be placed on the base 302 (specifically, on the upper, outer surface 334, thereof) or on the support structure 304 prior to placing the support structure 304 on the base 302, applying an adhesive or the like is not a necessary step since the weight of the load 356 will typically maintain the position of the base 302 under the load 356. Furthermore, because of the tubular configuration of the base 302, a forklift can lift both the base 302 and the load 356 (including the support structure 304), thereby maintaining the position of the base 302 under the load 356.

Figure 11:
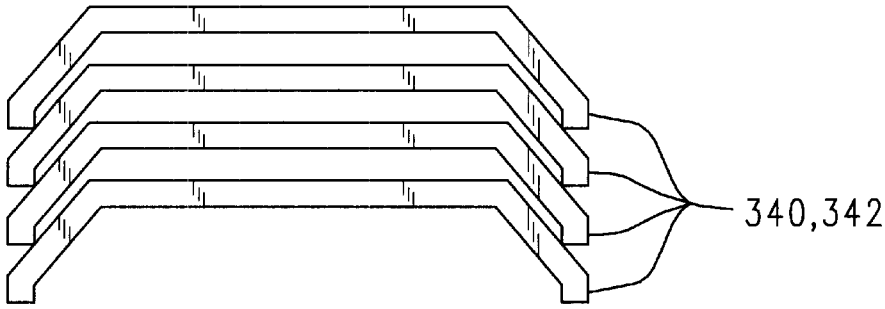
FIG. 11 is a front elevation view of a stack of disassembled elongate tubular members.

As shown in FIG. 11, in addition to preferably being identical to one another, the first and second portions 340, 342 when detached from one another are preferably nestable and stackable. In particular, upon disassembly of the pallet 300 (FIG. 7), the first and second portions 340, 342 of each of the elongate tubular members 330, 332 may be detached from one another and nestably stacked as shown in FIG. 11 for ease of storage, shipping, and/or disposal or recycling. The fact that an adhesive need not be applied to the elongate tubular members 330, 332 as discussed above simplifies and further accommodates the disassembly and recycling of the pallet 300.

FIGS. 12–16 illustrate various possible configurations of an elongate tubular member 330, 332, each preferably having first and second portions 340, 342 removably attached to one another. While no particular means for removably attaching the first and second portions 340, 342 is shown in FIGS. 12–16, it is to be understood that any means (such as, for example, the tongue-and-groove configuration shown in FIG. 9 and described above), conventional or otherwise, for removably attaching the first and second portions 340, 342 may be utilized with the configurations shown in FIGS. 12–16.

Figure 12:
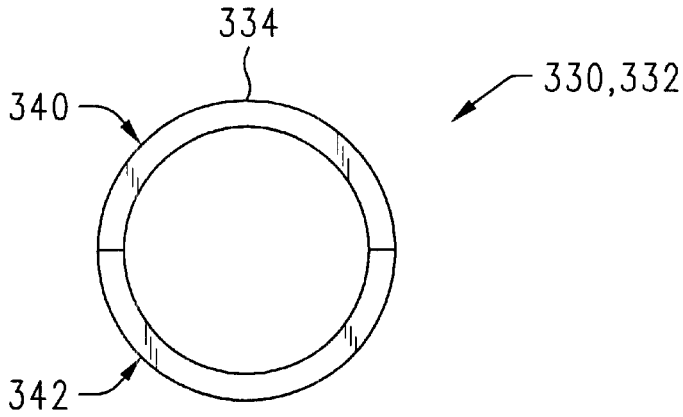
FIG. 12 is a front elevation view of another embodiment of the elongate tubular member of FIG. 8.
Figure 13:
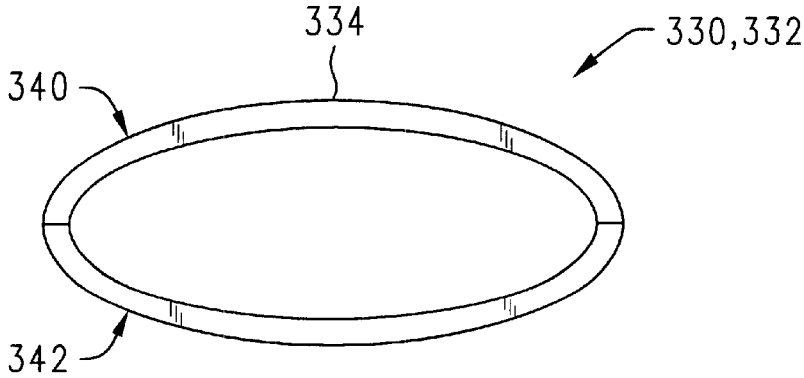
FIG. 13 is a front elevation view of yet another embodiment of the elongate tubular member of FIG. 8.

As shown in FIGS. 12 and 13, the elongate tubular member 330, 332 may have a substantially round (FIG. 12) or oval (FIG. 13) cross-sectional shape. As illustrated, the upper, outer surface 334 of the elongate tubular member 330, 332 (which is adapted to be positioned adjacent to the bottom surface 318, FIG. 7, of the support structure 304, as noted above) need not be substantially planar. However, when a load 356 (including a support structure 304, FIG. 10) is placed on a round or oval elongate tubular member 330, 332, at least a portion of the upper, outer surface 334 will naturally conform to the planar bottom surface 318 (FIG. 7) of the support structure 304.

Figure 14:
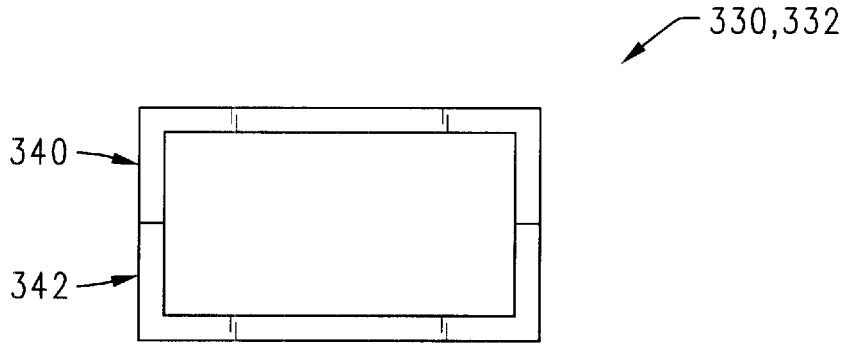
FIG. 14 is a front elevation view of yet another embodiment of the elongate tubular member of FIG. 8.
Figure 15:
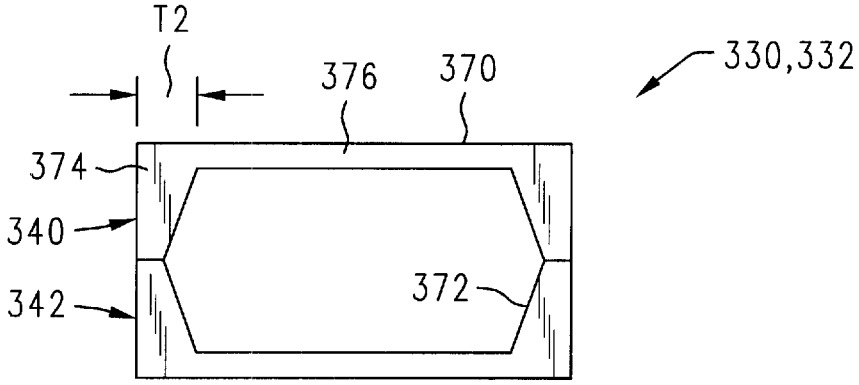
FIG. 15 is a front elevation view of yet another embodiment of the elongate tubular member of FIG. 8.

As shown in FIGS. 14 and 15, the elongate tubular member 330, 332 may have a substantially square cross-sectional shape. As shown in FIG. 15, the outer circumferential surface 370 of the elongate tubular member 330, 332 may have a different cross-sectional shape (e.g., square, as shown) than the inner circumferential surface 372. Such a configuration may be especially desirable for an elongate tubular member 330, 332 which is constructed from polystyrene ("Styrofoam") or the like which may derive a structural benefit from having certain portions (e.g., 374) which are relatively thicker than other portions (e.g., 376) of the member 330, 332.

Figure 16:
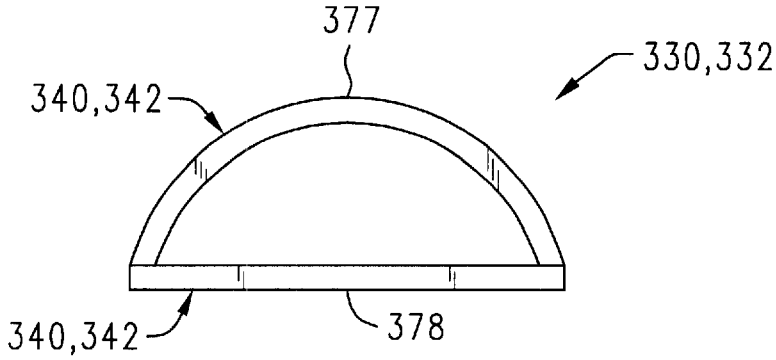
FIG. 16 is a front elevation view of still another embodiment of the elongate tubular member of FIG. 8.

As shown in FIG. 16, the elongate tubular member 330, 332 may comprise a first portion 340 having a rounded cross-sectional shape and a second portion 342 having a planar cross-sectional shape, whereby an upper, outer surface 377 is positioned adjacent to the bottom surface 318 of the support structure 304. Alternatively, as indicated in FIG. 16, this configuration may be inverted such that the first portion 340 may have a planar cross-sectional shape and the second portion 342 may have a rounded cross-sectional shape, whereby an upper, outer surface 378 is positioned adjacent to the bottom surface 318 of the support structure 304. This embodiment illustrates that the first and second portions 340, 342 of the elongate tubular member 330, 332 need not be identical.

While particular cross-sectional shapes have been illustrated in FIGS. 7–16, it is to be understood that such configurations are merely exemplary, and that elongate tubular members of various cross-sectional shapes not specifically described herein are within the scope of the present invention. However, in order to provide sufficient support for the load 356 (FIG. 10), the cross-sectional shape along at least a majority (i.e., greater than 50%) of the length ("WW2", FIG. 7) of each of the elongate tubular members 330, 332 should be a closed, continuous shape (i.e., not including, for example, an open L-shape or U-shape).

Figure 17:
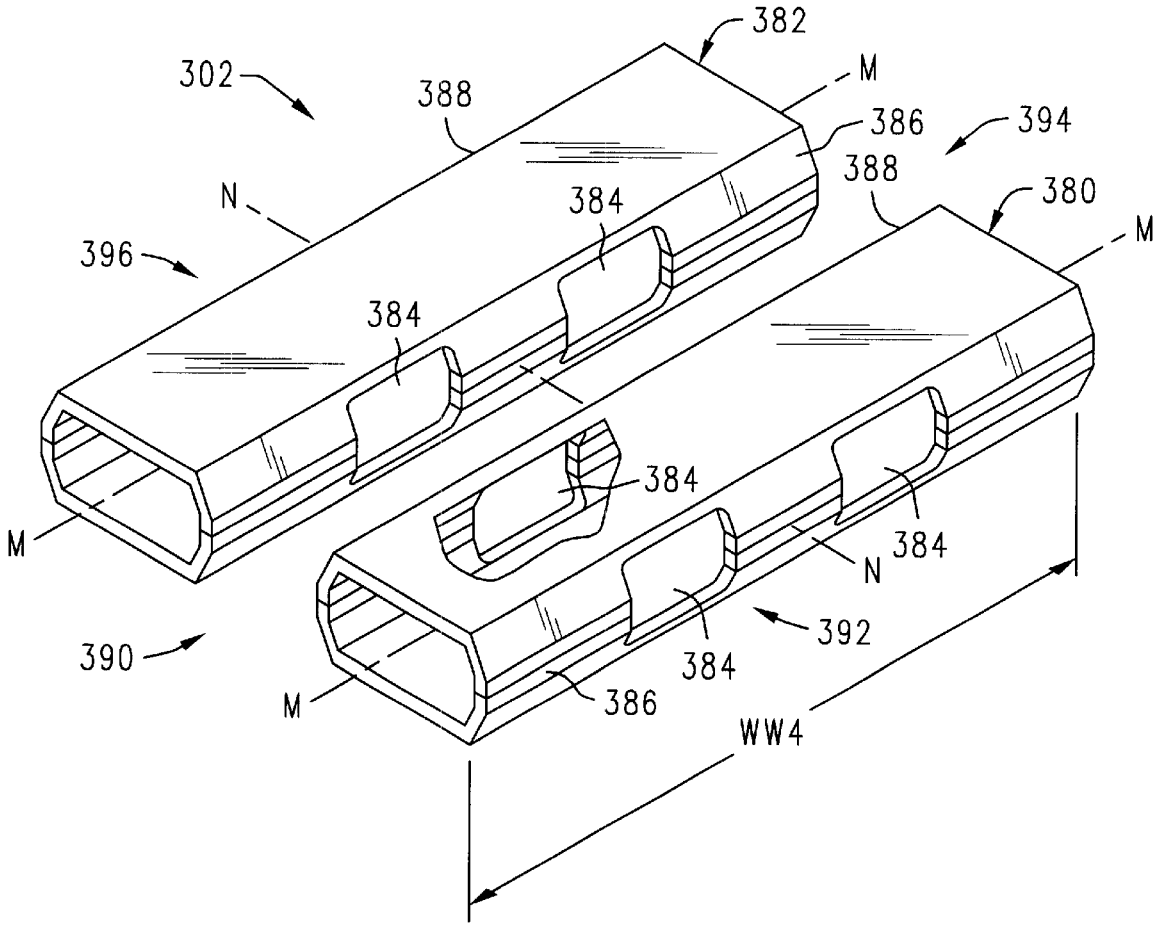
FIG. 17 is an isometric view of another embodiment of the elongate tubular members of FIGS. 7 and 8.

FIG. 17 illustrates another embodiment of the base 302 comprising at least one, and most preferably two, elongate tubular member(s) 380, 382. Each of the members may be identical, except where noted otherwise, to the elongate tubular members 330, 332 described above and have a length "WW4" which may be equal to the length "WW2" (FIG. 7) of the elongate tubular members 330, 332 described above. Each of the elongate tubular members 380, 382 may further comprise at least one (and most preferably two) opening(s) 384 in the elongate sides 386, 388 of the members 380, 382 which is/are adapted to receive forks (e.g., 56, FIG. 10) of a forklift. An opening 384 is shown in side 388 through a partially cutaway portion of member 380. With this configuration, a forklift may enter the base 302 from any side 390, 392, 394, 396 thereof, inserting its forks into the openings 384 in a direction substantially parallel to an axis "NN" which is generally perpendicular to the central longitudinal axis "MM". It is to be understood that this embodiment is not restricted to the elongate tubular members 330, 332 shown in FIGS. 7 and 17, and that any elongate tubular member configuration within the scope of the present invention (e.g., any of the configurations shown in FIGS. 12–16 as well as other configurations not specifically shown or described) may include such openings 384. As noted above, in order to provide sufficient support for the load 356 (FIG. 10), the cross-sectional shape along at least a majority of the length (e.g., "WW2", FIG. 7) of each of the elongate tubular members 380, 382 should be a closed, continuous shape. Since the cross-sectional shape of each of the elongate tubular members 380, 382 is not continuous and closed at the openings 384, the openings 384 in each of the sides 386, 388 should extend less than 50% along the length "WW4" of each of the elongate tubular members 380, 382.

While illustrative and presently preferred embodiments of the invention have been described in detail herein, it is to be understood that the inventive concepts may be otherwise variously embodied and employed, and that the appended claims are intended to be construed to include such variations, except as limited by the prior art.

We claim:

1. A pallet for supporting a load of packages comprising multiple layers, said pallet comprising:

a) a support structure comprising flexible film wrapped around at least one of said multiple layers around a first axis and a second axis, said first axis being generally perpendicular to said second axis, whereby said flexible film covers at least a majority of said at least one of said multiple layers, said support structure comprising a bottom surface; and b) a base constructed from a disposable/recyclable material, said base comprising at least one elongate tubular member comprising an upper, outer surface positioned adjacent to said bottom surface of said support structure and at least one opening therethrough extending along a central longitudinal axis which is adapted to receive forks of a forklift.

2. The pallet of claim 1, said base comprising two of said elongate tubular members each comprising said opening therethrough extending along said central longitudinal axis which is adapted to receive a fork of a forklift.

3. The pallet of claim 1, said bottom surface of said support structure having a first end and a second end, wherein said at least one elongate tubular member extends along said central longitudinal axis substantially from said first end to said second end of said support structure.

4. A pallet for supporting a load of packages comprising multiple layers, said pallet comprising:

a) a support structure comprising flexible film wrapped around at least one of said multiple layers around a first axis and a second axis, said first axis being generally perpendicular to said second axis, whereby said flexible film covers at least a majority of said at least one of said multiple layers, said support structure comprising a bottom surface; and b) a base constructed from a disposable/recyclable material, said base comprising at least one elongate tubular member comprising an upper, outer surface positioned adjacent to said bottom surface of said support structure and at least one opening therethrough extending along a central longitudinal axis which is adapted to receive forks of a forklift, said at least one elongate tubular member further comprising a first portion removably attached to a second portion, said first portion having said upper, outer surface.

5. The pallet of claim 4, said first portion being identical to, nestable with, and stackable with said second portion.

6. The pallet of claim 1, said at least one elongate tubular member having a length and a closed, continuous cross-sectional shape along at least a majority of said length and further comprising a first elongate side, a second elongate side, and at least one opening in each of said first elongate side and said second elongate side, said at least one opening being adapted to receive forks of a forklift in a direction which is substantially perpendicular to said central longitudinal axis.

7. A pallet for supporting a load of packages comprising multiple layers, said pallet comprising:

a) a support structure comprising flexible film wrapped around at least one of said multiple layers around a first axis and a second axis, said first axis being generally perpendicular to said second axis, whereby said flexible film covers at least a majority of said at least one of said multiple layers, said support structure comprising a bottom surface; and b) a base constructed from a disposable/recyclable material, said base comprising at least one elongate tubular member comprising an upper, outer surface positioned adjacent to said bottom surface of said support structure and at least one opening therethrough extending along a central longitudinal axis which is adapted to receive forks of a forklift, said at least one elongate tubular member further comprising a first portion having a first elongate, substantially planar panel and a first pair of elongate side panels extending therefrom substantially parallel to said central longitudinal axis, and a second portion having a second elongate, substantially planar panel and a second pair of elongate side panels extending therefrom substantially parallel to said central longitudinal axis, wherein said first pair of elongate side panels is removably attached to said second pair of elongate side panels.

8. The pallet of claim 1 wherein said base is constructed from a disposable/recyclable material.

9. The pallet of claim 8 wherein said disposable/recyclable material is chosen from the group consisting of polypropylene, structural foam, expanded polystyrene, polyethylene, and polystyrene.

10. A pallet for supporting a load of packages comprising multiple layers, said pallet comprising:

a) a support structure comprising flexible film wrapped around at least one of said multiple layers around a first axis and a second axis, said first axis being generally perpendicular to said second axis, whereby said flexible film covers at least a majority of said at least one of said multiple layers, said support structure comprising a bottom surface; and b) a base comprising two elongate tubular members, each of said elongate tubular members comprising an opening therethrough extending along a central longitudinal axis which is adapted to receive a fork of a forklift and a first portion removably attached to a second portion, said first portion having an upper, outer surface positioned adjacent to said bottom surface of said support structure.

11. The pallet of claim 10, said bottom surface of said support structure having a first end and a second end, wherein each of said elongate tubular members extends along said central longitudinal axis substantially from said first end to said second end of said support structure.

12. The pallet of claim 10, said first portion being identical to, nestable with, and stackable with said second portion.

13. The pallet of claim 10, each of said elongate tubular members having a length and a closed, continuous cross-sectional shape along at least a majority of said length and further comprising a first elongate side, a second elongate side, and at least one opening in said first elongate side and said second elongate side, said at least one opening being adapted to receive forks of a forklift in a direction which is substantially perpendicular to said central longitudinal axis.

14. The pallet of claim 10, said first portion comprising a first elongate, substantially planar panel and a first pair of elongate side panels extending therefrom substantially parallel to said central longitudinal axis, and said second portion comprising a second elongate, substantially planar panel and a second pair of elongate side panels extending therefrom substantially parallel to said central longitudinal axis, wherein said first pair of elongate side panels is removably attached to said second pair of elongate side panels.

15. The pallet of claim 10 wherein said base is constructed from a disposable/recyclable material.

16. The pallet of claim 15 wherein said disposable/recyclable material is chosen from the group consisting of polypropylene, structural foam, expanded polystyrene, polyethylene, and polystyrene.

17. A pallet for supporting a load of packages, comprising:

a) a support structure comprising a bottom surface, a first end and a second end; and b) a base constructed from a disposable/recyclable material, said base comprising a first elongate tubular member having a first central longitudinal axis and comprising an opening therethrough which is adapted to receive a fork of a forklift and a second elongate tubular member having a second central longitudinal axis substantially parallel to said first longitudinal axis which is substantially identical to said first elongate tubular member, each of said first elongate tubular member and said second elongate tubular member having a length extending substantially from said first end to said second end of said support structure and a closed, continuous cross-sectional shape along at least a majority of said length and, each of said first elongate tubular member and said second elongate tubular member comprising:

i) a first portion having an upper, outer surface positioned adjacent to said bottom surface of said support structure; and ii) a second portion removably attached to said first portion.

18. The pallet of claim 17, said first portion being identical to, nestable with, and stackable with said second portion.

19. The pallet of claim 17, each of said first elongate tubular member and said second elongate tubular member having a length and a closed, continuous cross-sectional shape along at least a majority of said length and further comprising a first elongate side, a second elongate side, and at least one opening in each of said first elongate side and said second elongate side, said at least one opening being adapted to receive forks of a forklift in a direction which is substantially perpendicular to each of said first central longitudinal axis and said first central longitudinal axis.

20. The pallet of claim 17, said first portion comprising a first elongate, substantially planar panel and a first pair of elongate side panels extending therefrom substantially parallel to said first central longitudinal axis, and said second portion comprising a second elongate, substantially planar panel and a second pair of elongate side panels extending therefrom substantially parallel to said second central longitudinal axis, wherein said first pair of elongate side panels is removably attached to said second pair of elongate side panels.

21. The pallet of claim 17 wherein said disposable/recyclable material is chosen from the group consisting of polypropylene, structural foam, expanded polystyrene, polyethylene, and polystyrene.

22. A method for producing a pallet for supporting a load of packages comprising multiple layers, said method comprising:

a) wrapping at least one of said multiple layers with a flexible film around a first axis;

b) wrapping said at least one of said multiple layers with a flexible film around a second axis which is generally perpendicular to said first axis, thereby producing a support structure;

c) placing said support structure on a base comprising at least one elongate tubular member having at least one opening therethrough extending along a central longitudinal axis which is adapted to receive forks of a forklift.

23. A method for producing a pallet for supporting a load of packages comprising multiple layers, said method comprising:

a) wrapping at least one of said multiple layers with a flexible film around a first axis;

b) wrapping said at least one of said multiple layers with a flexible film around a second axis which is generally perpendicular to said first axis, thereby producing a support structure;

c) assembling a base by removably attaching a first portion to a second portion, thereby producing a first elongate tubular member having a first opening therethrough extending along a first central longitudinal axis, and then removably attaching a third portion to a fourth portion, thereby producing a second elongate tubular member having a second opening therethrough extending along a second central longitudinal axis which is substantially parallel to said first central longitudinal axis, each of said first opening and said second opening being adapted to receive a fork of a forklift; and d) placing said support structure on said base.

24. A pallet for supporting a load of packages comprising multiple layers, said pallet comprising:

a) support means for supporting said load of packages, said support means comprising flexible film wrapped around at least one of said multiple layers around a first axis and a second axis, said first axis being generally perpendicular to said second axis, whereby said flexible film covers at least a majority of said at least one of said multiple layers; and b) elongate tubular base means positioned adjacent to said support means for receiving forks of a forklift.

* * * * *